US005256316A

United States Patent [19]

Suzuki et al.

[11] Patent Number: 5,256,316

[45] Date of Patent: Oct. 26, 1993

[54] BRIGHTENING CHEMICAL POLISHING SOLUTION FOR HARDENED STEEL ARTICLE

[75] Inventors: Kenichi Suzuki; Masaki Kajino, both of Nagoya; Kazuyoshi Ogawa, Kasugai; Takashi Asano, Ama; Mineo Ogino, Aichi; Hideo Aihara, Toyota; Fumio Shimizu, Aichi; Masazumu Onishi; Yasuyuki Suzuki, both of Toyota, all of Japan

[73] Assignees: Kabushiki Kaisha Toyota Chuo Kenkyusho, Aichi; Toyota Jidosha Kabushiki Kaisha, Toyota, both of Japan

[21] Appl. No.: 799,313

[22] Filed: Nov. 27, 1991

[30] Foreign Application Priority Data

Nov. 27, 1990 [JP] Japan ..... 2-328190
Nov. 28, 1990 [JP] Japan ..... 2-331257
Nov. 7, 1991 [JP] Japan ..... 3-321128

[51] Int. Cl.[5] ..... H01L 21/00

[52] U.S. Cl. ..... 252/79.1; 156/664; 252/79.3; 252/79.4

[58] Field of Search ..... 252/79.3, 79.1, 79.4; 156/664

[56] References Cited

U.S. PATENT DOCUMENTS 3,992,235 11/1976 Gabarini ..... 252/79.3
4,459,216 7/1984 Nakazato et al. .

FOREIGN PATENT DOCUMENTS 0115450 8/1984 European Pat. Off. .
0368638 5/1990 European Pat. Off. .
48-052638 7/1973 Japan .
62-24000 1/1987 Japan .
62-2037660 9/1987 Japan .
1-264727 10/1989 Japan .
2-129421 5/1990 Japan .
2-129422 5/1990 Japan .
WO91/05079 4/1991 PCT Int'l Appl. .
1164347 9/1969 United Kingdom .

OTHER PUBLICATIONS

Patent Abstracts of Japan, vol. 12, No. 57, (M-670), Feb. 20, 1988, & JP-A-62-203 766, Sep. 8, 1987, K. Ogawa, et al. "Method of Treating Surface of Cemented and Quenched Layer".

Patent Abstracts of Japan, vol. 11, No. 24, (C-399)(2471), Jan. 23, 1987, & JP-A-61 199 084, Sep. 3, 1986, S. Nakada, et al., "Manufacture of Cr Stainless Steel Sheet".

*Primary Examiner*—Brian E. Hearn
*Assistant Examiner*—George Goudreau
*Attorney, Agent, or Firm*—Oblon, Spivak, McClelland, Maier & Neustadt

[57] ABSTRACT

A brightening chemical polishing solution for a hardened steel article (e.g., a carburized and quenched gear) comprises hydrofluoric acid having a molar concentration of from 0.2 to 2 mol/l, hydrogen peroxide having a molar concentration of from 0.4 to 4 mol/l, and water, a molar ratio of the hydrofluoric acid to the hydrogen peroxide being from 1:1.5 to 1:2.8. The steel article is quench hardened and is chemically polished in the solution. A shot-peening is additionally performed, prior to the polishing.

8 Claims, 1 Drawing Sheet

BRIGHTENING CHEMICAL POLISHING SOLUTION FOR HARDENED STEEL ARTICLE

BACKGROUND OF THE INVENTION

1. Field of the Invention

The present invention relates to a (brightening) chemical polishing solution for a hardened steel article, and a method of chemically polishing the hardened steel article by using the solution.

The present invention can be applied to hardened steel articles having a complicated shape, e.g., hardened gears used in a transmission gear, a differential gear and the like, to improve the properties of these articles, such as the surface roughness, fatigue strength, and wear resistance thereof.

2. Description of the Related Art

Steel articles requiring a high strength, e.g., transmission gears of automobiles, are subjected to a case-hardening heat-treatment, particularly, a carburizing and quench hardening treatment, and a carburized and quench hardened layer formed in the surface portion of the steel article (gear) has a high hardness and a residual compressive stress which improve the fatigue strength and wear resistance of the article. Recently, as the power output by automobile engines is increased, a greater fatigue strength is required of such articles.

A carburized and hardened steel article, however, has an abnormal layer, regarded as an oxidized and non-martensitic layer, having a depth of from 5 to 50 μm from the surface thereof, and as such an abnormal layer has a hardness lower than that of the normal hardened layer existing thereunder, and thus lowers the residual compressive stress at the top surface, the abnormal layer is a factor in the lowering of the fatigue strength; a large surface roughness is another factor in the lowering of the fatigue strength, whether or not the abnormal layer exists.

To improve the fatigue strength of steel articles, shot-peening has been adopted as an additional process giving a relatively high compressive stress to a surface layer having a depth of from 200 to 400 μm from the top surface thereof. The residual compressive stress caused by the shot-peening has a peak value at from 10 to 100 μm from the top surface which is lower than the peak value thereof at a portion above the former-mentioned position According to the shotpeening process, the steel articles are bombarded with hard particles at a high speed, and thus surface damage is liable to occur. Furthermore, the abnormal layer of the carburized and hardened steel article is hardly removed by the shot-peening, and thus a portion thereof remains. Such damage and the remaining abnormal layer portion are liable to become initiation points of fatigue crack, and hinder a stable and marked improvement of the fatigue strength.

A mechanical polishing process for removing this abnormal layer has been proposed in, e.g., "A Process for Producing a High Strength Gear" (Japanese Unexamined Patent Publication (Kokai) No. 01-264727, published on Oct. 23, 1989), in which a steel article (gear) is subjected to a carburizing and quench hardening treatment, and shot-peening, and is then ground with a grinding wheel of cubic boron nitride. The high hardness of the hardened article, however, lowers the grinding efficiency of the mechanical grinding. In particular, articles with a complicated shape, such as tooth-roots of a gear required a fatigue strength can not be precisely ground, with high efficiency. On the other hand, electrolytic polishing has been proposed in, e.g., Japanese Unexamined Patent Publication (Kokai) Nos. 62-24000 (published on Jan. 31, 1987), 02-129421 (published on May 17, 1990), and 02-129422 (published on May 17, 1990). According to the above Publication No. 62-24000 (Electrolytic Polishing Process of Gears), electrodes are arranged near the tooth-bottom of a carburized and hardened gear, and an electrolytic polishing solution is sprayed toward the tooth-bottom, to thereby etch the tooth-bottom only. In this case, it is necessary to change the position of the electrodes, depending on the shape of the steel article, to ensure a dimensional accuracy, and thus this electrolytic polishing device has a complicated structure Furthermore, according to the above Publication Nos. 02-129421 and 02-129422 (High Strength Coil Spring and Method of Producing the Same), a spring of chromium-vanadium steel is quench-hardened, tempered and shot-peened, and then subjected to an electrolytic polishing treatment In this case, surface damages are removed to attain a surface roughness ($R_{max}$) of 5 μm or less, but the accuracy of the spring is not so severe. If the methods of these publications apply to articles (e.g., gears) required of a strict accuracy, the problem pointed out in the above Publication No. 62-24000 also occurs.

Taking the above-mentioned conventional processes and disadvantages into consideration, the present inventors though investigated the use of chemical polishing process for polishing a hardened steel article. A chemical polishing process for steel articles was proposed by, e.g., U.S. Pat. No. 3,369,914 (Method of Chemically Polishing Iron, Zinc and Alloys thereof). U.S. Pat. No.' 914 uses an aqueous solution of hydrogen fluoride and hydrogen peroxide, a molecular ratio of hydrogen peroxide to hydrogen fluoride being between about 3:1 and 7:1, and states that a metal component part is immersed in this solution bath for 1 minute to obtain a shining surface of the component part. It is possible to apply this polishing process to a pretreatment for plating, a treatment for improving a corrosion resistance, and a brightening treatment, without considering the polishing rate or polishing amount, but if this process is applied to a precision polishing of articles such as hardened gears, requiring a precise dimensional accuracy, since U.S. Pat. No. ' 914 does not disclose suitable conditions for such a precision polishing treatment, a person skilled in the art cannot apply this process to a final polishing of parts. Furthermore, since the molar ratio of hydrogen peroxide to hydrogen fluoride is large (3 to 7), the hydrogen peroxide in the solution is liable to decompose during its solution is not used with the result that expensive hydrogen peroxide is wasted and the polishing solution is not suitable for an industrial polishing treatment, from the viewpoint of solution stability.

Furthermore, regarding the shot-peening, a "Method of Treating a Surface of a Carburized and Hardened Layer" (Japanese Unexamined Patent Publication (Kokai) No. 62-203766 (published on Sept. 8, 1987) was proposed, in which a steel article (e.g., a gear) is carburized and hardened, an abnormal layer is removed by a chemical dissolving (etching treatment, and the article surface is then shot-peened. In this case, the chemical dissolution (etching) produces a surface roughness ($R_{max}$) of several tens of micrometers, and the shot-peening reduces this roughness. Nevertheless, although the abnormal layer is removed, the shot-peening damages the article surface, and thus no remarkable improvement of the fatigue strength is obtained.

SUMMARY OF THE INVENTION

An object of the present invention is to provide a solution suitable for brightly and chemically polishing a hardened steel article with a complicated shape, to thereby improve the properties, such as fatigue strength, surface roughness and luster, of the article.

Another object of the present invention is to provide a method of chemically polishing and brightening a hardened steel article at a high accuracy and a high efficiency without a special polishing device.

These and other objects of the present invention are attained by providing a brightening chemical polishing solution for a hardened steel article, which solution comprises hydrofluoric acid having a molar concentration of from 0.2 to 2 mol/l, hydrogen peroxide having a molar concentration of from 0.4 to 4 mol/l, and water, a molar ratio of said hydrofluoric acid to said hydrogen peroxide being in the range of from 1:1.5 to 1:2.8.

The above-mentioned and other objects are also attained by a method of bright-chemical-polishing a hardened steel article, the method comprising the steps of: hardening the steel article, and thereafter, polishing the hardened steel article with the above-mentioned brightening chemical polishing solution. Preferably, the method further comprises a shot-peening step carried out between the hardening step and the chemical polishing step.

In general, a chemical polishing solution comprises an acid and an oxidizer According to the present invention, the hydrofluoric acid (solution of hydrogen fluoride (HF)) is adopted as the acid for dissolving (chemically attacking) a hardened steel article, since iron (Fe) ions eluted from the article are stabilized as complex ions of $FeF_3^{3-}$ or the like in the solution bath. As a result, a catalytic action of complex ions is reduced, and thus this solution can be used industrially for such a treatment. The hydrofluoric acid used in the present invention can be prepared as hydrogen fluoride (99% or more) or diluted hydrofluoric acid. Preferably the diluted hydrofluoric acid is in a concentration of about 50%, from the viewpoint of easy handling thereof in preparation of a polishing solution, and the commercially availability thereof According to the present invention, a concentration of the hydrofluoric acid ranges from 0.2 to 2 mol/l, preferably from 0.3 to 1.5 mol/l. The hydrofluoric acid concentration influences the polishing rate (i.e., metal dissolution rate) in connection with a bath (solution) temperature. At a constant bath temperature, the higher the hydrofluoric acid concentration, the higher the polish rate. During the polishing step, the bath temperature is remarkably elevated due to the reaction heat and thus the polishing rate is inevitably increased. Where the concentration is more than 2 mol/l, it is difficult to suitably control the polishing rate, but if the concentration is less than 0.2 mol/l, the polishing rate is less than 1 μm/min, and thus the polishing efficiency is too low. It is industrially preferable that the polishing rate is from 1 to 100 μm/min, and the hydrofluoric acid concentration is determined to be from 0.2 to 2 mol/l, to obtain the preferable polishing rate. Where the hydrofluoric acid has a concentration of from 0.3 to 1.5 mol/l, a practical polishing rate of 2 to 50 μm/min is obtained, and a control and maintenance of the polishing rate is facilitated.

BRIEF DESCRIPTION OF THE DRAWING

The present invention will be more apparent from the description of the preferred embodiments set forth below, with reference to the accompanying drawing, in which.

DESCRIPTION OF THE PREFERRED EMBODIMENTS

Figure 1:
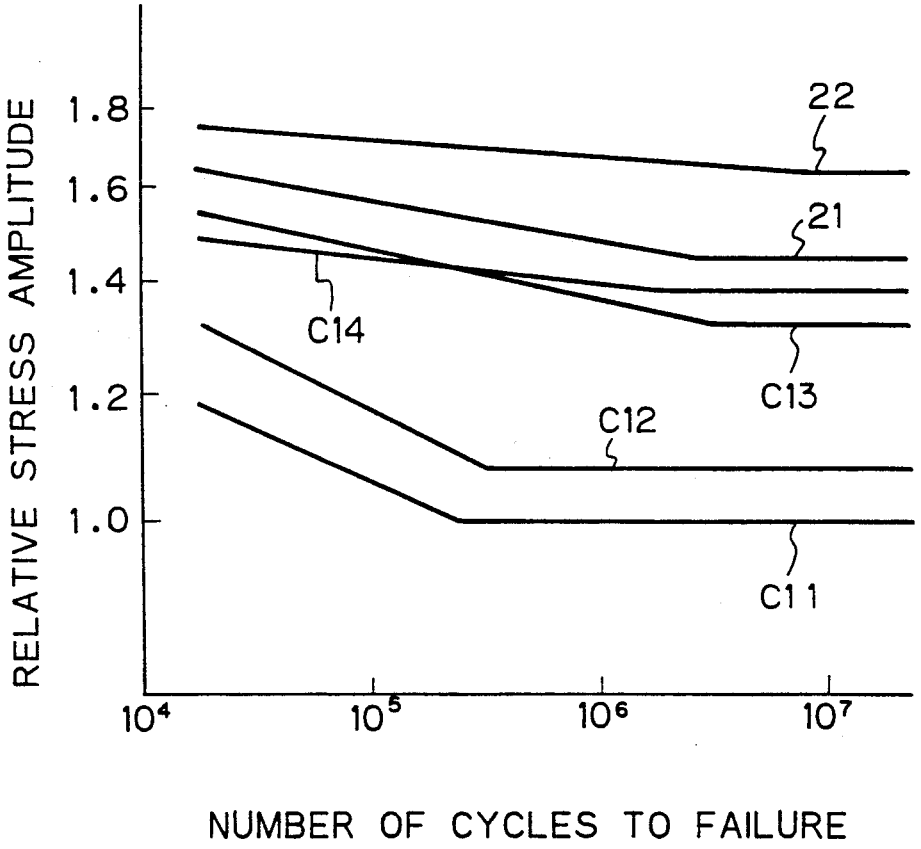
FIG. 1 is an S-N diagram showing a relationship between the relative stress amplitude and the number of cycles to failure.

According to the present invention, the hydrogen peroxide ($H_2O_2$) is adopted as the oxidizer accelerating dissolution of Fe and has a micro-smoothing (i.e., brightening) action, since the hydrogen peroxide has a strong oxidizing power and forms by-products of water ($H_2O$) and oxygen gas ($O_2$) after the polishing reaction. Such by-products do not hinder the polishing step even over a long operation time, and are favorable for a waste solution treatment. It is preferable to use a hydrogen peroxide having a concentration of from 30 to 60%, which is commercially available as an industrial chemical. According to the present invention, a concentration of the hydrogen peroxide ranges from 0.4 to 4 mol/l, preferably from 0.6 to 3 mol/l. At less than 0.4 mol/l of the hydrogen peroxide concentration will degrade a luster of the polished surface, and at more than 4 mol/l, will cause a remarkable decomposition due to reaction heat, thereby making it difficult to control the polishing solution. Furthermore, a hydrogen peroxide concentration of 0.6 mol/l or more stably provides a satisfactory glossy surface, and that of 3.0 mol/l or less almost eliminates the hydrogen peroxide decomposition based on reaction heat. The suitable concentration of the hydrogen peroxide depends mainly on the hydrofluoric acid concentration.

The chemical polishing solution according to the present invention comprises the hydrofluoric acid and the hydrogen peroxide at a suitable mixing ratio, to thereby polish and brighten a hardened steel article at a practical polishing rate. According to the present invention, the molar ratio of the hydrofluoric acid to the hydrogen peroxide ranges from 1:1.5 to 1:2.8, preferably from 1:1.6 to 1:2.4. In an electrochemical model of an acid dissolution of metal, where the hydrogen peroxide and the hydrofluoric acid coexist in the solution, the hydrogen peroxide is decomposed at a surface of the steel article, to thus generate oxygen, and the nascent oxygen exhibits a strong oxidation power to promote a transpassive dissolution of the article surface. With such a transpassive dissolution, it is possible to prevent a nonuniform dissolution of the article surface, based on a metal structure or the like, to thereby form an evenly brightened surface. The formation of the transpassivity substantially depends on the dissolution power of the hydrofluoric acid and oxidation power of the hydrogen peroxide, and is stably maintained in the above-mentioned molar ratio range. Such a chemical dissolution action (i.e., transpassivity) of the chemical polishing solution according to the present invention promotes a uniform polishing of the steel article, regardless of the shape or hardness of the hardened steel article. A molar ratio of less than 1:1.5 will degrade the luster of the article surface, since the micro-smoothing action is insufficient, and a molar ratio of more than 1 2.8 will have no advantage over the claimed molar ratio range, although it will not degrade the luster, wastes the expensive hydrogen peroxide, and easily causes variations in the bath (solution) composition. A molar ratio of 1.6 mol/l or more provides a more satisfactory glossy surface, despite concentration variations caused by additional supply for consumed hydrofluoric acid and hydrogen peroxide in a continuous operation, and a molar ratio of 2.4 mol/l or less suitably suppresses variations in the composition of the solution and effectively prevents waste of the expensive hydrogen peroxide.

When preparing the chemical polishing solution having a predetermined composition, it is preferable to weigh or measure by volume the diluted hydrofluoric acid and the hydrogen peroxide aqueous solution, as commercial chemicals, mix same, and add water to the mixed solution to control the component concentrations. Such a preparation method is most usual, but it is possible to adopt other preparation methods. Namely, it is possible to use these chemicals and diluting water containing impurities, as long as the polishing is not hindered. Preferably, the chemicals are a reagent first grade or better, and the water is a deionized water.

Preferably, the chemical polishing solution further comprises one of purine alkaloid compounds, as a stabilizer for the hydrogen peroxide. The addition of the purine alkaloid compound contributes to a further stabilizing of the chemical polishing solution, and enables the solution to be used despite an accumulation of metal ions at a high concentration during the polishing step, and thus the stabilizer extends the service life of the solution when used on an industrial scale. Since the effect of the stabilizer is unchanged by heat, an activation of the chemical reaction due to the raising of the bath (solution) temperature is utilized for increasing a process capability (i.e., raising the polishing rate under a suitable control), and thus the stabilizer can lower the cost and raise the production efficiency of the chemical polishing treatment. Since the purine alkaloid compounds are a vegetable matter widely found in nature, they are not harmful to workers' health.

The compounds are water-soluble basic organic compounds, such as caffeine, theophylline and theobromine, having a prime structure shown in the following formula.

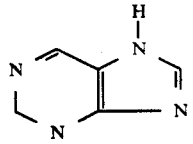

Preferably, the compound has a concentration of from 0.1 to 30 g/l in the polishing solution. A concentration of less than 0.1 g/l will weaken the effect of suppressing the decomposition of the hydrogen peroxide, and that of more than 30 g/l will not obtain an effect corresponding to the addition amount and is not economical.

The quench hardening method used for the hardened steel article may be a carburizing and quenching method, an induction hardening method, a flame hardening method, or the like. After the quench hardening, a usual tempering may be performed. Preferably, most of the hardened metal structure is composed of martensite. The hardened steel includes carbon steel, chromium steel, chromium-molybdenum steel, nickel-chromium-molybdenum steel and the like, which can be easily dissolved by an acid solution Since some steels, such as stainless steel, having a very strong resistance to acid does not substantially chemically dissolvable, the present invention is not applied to such steels. Where a steel has precipitate particles stable to acid, such as various carbides, a grain size of the precipitate particles should be small. Furthermore, it is preferable to minimize nonmetallic inclusions contained in the matrix, since the inclusions are liable to serve as initiation points of fatigue crack. The steel article can have any shape, as long as a surface to be polished of the article comes sufficiently into contact with the chemical polishing solution in a bath, and the solution runs on the surface. Therefore, it is undesirable that the article has a very narrow gap portion or a cavity portion. If the article has such undesirable portions, it is necessary to change the solution application conditions, e.g., to make a jet of the solution impinge on such portions.

Where the heat-treated steel article has a clean surface, the article may be directly subjected to the chemical polishing, but usually dirt, oil and the like adhere to the article, and thus this should be removed by a cleaning treatment prior to the chemical polishing. The cleaning treatment can be carried out in a usual way using, e.g., a cleaning agent such as an organic solvent and an alkaline cleaner. Where the hardened steel article has an oxide scale on the surface thereof, it is unnecessary to remove the normal scale, but it is preferable to remove very thick scale strongly adhering to the surface, by a mechanical stripping method (e.g., a shot-blasting method) or an etching method.

The hardened steel article, after such a pretreatment as required, is immersed in the chemical polishing solution having the predetermined concentrations of the hydrofluoric acid and hydrogen peroxide in accordance with the present invention. The chemical polishing treatment proceeds together with a generation of an oxygen gas naturally causing strong stirring of the solution, and thus it is unnecessary to additionally fit a stirring means to a solution bath. Furthermore, a heat generated by a chemical reaction raises the bath temperature, which raises the polishing rate. To ensure the precision of the size and surface condition of the article, it is preferable to maintain the bath temperature at a constant value. Such an immersing treatment is performed for a certain time, to obtain the desired polishing amount, and thereafter, the article is taken out of the bath, washed and dried. Under certain circumstances the polished surface becomes discolored (rust-colored) during such an after-treatment, and such surface is not desirable for special use. In this case, the discoloration can be prevented by adding a pickling step using a dilute acid (e.g., a hydrochloric acid ranging from 2 to 3% in concentration) and then an alkaline neutralizing step, prior to the washing step. In the chemical polishing step, according to another embodiment of the present invention, the hardened steel article is mainly polished in a (first) chemical polishing solution having relatively high concentrations of the hydrofluoric acid and hydrogen peroxide, and then additionally polished in another (second) chemical polishing solution having relatively low concentrations.

For example, it is preferable to carry out the chemical polishing step in two stages, i.e., a first stage of mainly polishing the hardened steel article in a first chemical polishing solution comprising hydrofluoric acid having a molar concentration of from 0.8 to 1.5 mol/l, hydrogen peroxide having a molar concentration of from 1.6 to 3 mol/l, and water, a molar ratio of said hydrofluoric acid to said hydrogen peroxide being from 1:1.6 to 1:2.4, and then a second stage of additionally polishing the article in a second chemical polishing solution comprising hydrofluoric acid having a molar concentration of from 0.2 to 0.8 mol/l, hydrogen peroxide having a molar concentration of from 0.4 to 1.6 mol/l, and water, a molar ratio of said hydrofluoric acid to said hydrogen peroxide being from 1:1.5 to 1:2.8.

When the washing step is performed a certain time after the end of the first polishing stage using the (first) high concentration chemical polishing solution, the remaining solution adhering to the article surface further reacts (over-reacts) therewith, prior to the washing, to deteriorate the luster of the article surface. In this case, the polished article is repolished by using the (second) low concentration chemical polishing solution, to restore the glossy surface. The low concentration solution adhering to the surface chemically reacts with the article surface at a low reaction rate, and thus the glossy surface is maintained. Therefore, the two stage polishing process is suitable for an industrial, i.e., continuous and/or mass operation.

According to the other embodiment of the present invention, prior to the chemical polishing step, the hardened steel article is subjected to shot-peening, to further improve the fatigue strength. Such shot-peening usually generates a residual compressive stress extending in the article to a depth of 200 to 400 μm from the surface thereof. The residual stress has a peak value at a depth of 10 to 100 μm from the surface. The shot-peening has an effect of suppressing a a growth of fatigue crack. The shot-peening is performed by striking shots (hard particles) against the article surface (i.e., by bombarding the surface with the shots) with a commercial shooting device under conditions similar to those for treating ordinary steel articles. For providing a large peening effect, the shot material has a relatively high density and a high hardness, and is, e.g., steel having an HV450 to HV1000 (preferably, HV600 to HV1000). The larger the shot size, the deeper the effective depth of the peening effect, but the smaller the number of the shots, the more extended the peening time. Preferably, the shot size is in the range of 0.2 to 1 mm. Where the steel article, e.g., a gear, has fillet portions (tooth-roots or tooth-bottom), the shots are smaller than one-half of the smallest fillet radius, for providing an effective peening of the fillet portions, and should be near such a size. A strength of the shot-peening is larger than 0.1 mm in arc height. If the strength is smaller than 0.1 mm in arc height, it is difficult to attain a suitable peening effect. Preferably, a speed of the shot jet is in the range of 30 to 70 m/sec, which is obtained by accelerating the shots with an impeller or a compressed air. Preferably, the shot time is from 0.5 to 10 minutes. A conventional shot-peening is carefully performed (under limited conditions), to thus prevent surface damage, but the surface damage caused by the shot-peening is easily removed by the following chemical polishing according to the present invention, with the result that the shotpeening conditions are more freely determined.

Moreover, the chemical polishing treatment chemically dissolves and removes a surface layer including the shot-peening surface damage and the abnormal layer caused by the carburizing and quenching treatment, as mentioned above Since a thickness of 5 to 50 μm is removed in accordance with the chemical polishing process of the present invention, such a harmful surface layer is completely removed, to thereby expose the surface with the residual compressive stress at the peak value or in the vicinity thereof. Therefore, the finally obtained steel article has a defect-free smooth surface having a high residual compressive stress, and thus the surface dependence of the fatigue failure is greatly lowered to thereby remarkably increase the fatigue strength.

As mentioned above, the chemical polishing method according to the present invention is widely applied to hardened steel articles, especially those with complicated shapes which are difficult to polish by a mechanical polishing method and an electrolytic polishing method. The chemical polishing method improves the polishing finish, fatigue strength, friction property, and wear-resistance. Furthermore, the addition of the shot-peening further improves the fatigue strength.

EXAMPLE 1

Samples having a size of 15 mm×10 mm×50 mm were made of a chromium steel (JIS SCr 420H) and were finished at a surface roughness Rz of 3 to 4 μm by cutting. Then the samples were carburized, quench hardened and tempered under the conditions shown in Table 1.

TABLE 1

| Treatment | Condition |
|---|---|
| Carburizing | 930–950° C. × 150–240 min |
| Quenching | 850° C. × 30–60 min Holding and then Oil Cooling |
| Tempering | 130–160° C. × 60–120 min Holding and then Air Cooling |

Chemical polishing solutions (500 ml) were prepared by mixing a commercial reagent grade hydrofluoric acid (47%), a commercial reagent grade hydrogen peroxide aqueous solution (30%), and deionized water to attain predetermined compositions shown in Table 2. The solutions for sample Nos. 1 to 15 had compositions according to the present invention, and the solutions for sample Nos. C1 to C6 were comparative examples.

After the samples were degreased with an alkaline cleaner, the samples were immersed in the chemical polishing solutions for 2 minutes, and then were washed, drained, and dried. The surfaces of the samples were checked to determine whether or not a good luster had appeared, and a polished depth of the samples was measured to thereby calculate the polishing rate. The results are shown in Table 2.

TABLE 2

| | Solution Composition | | | | Ability Estimation | |
|---|---|---|---|---|---|---|
| Sample No. | Hydrofluoric Acid (Mol/l) | Hydrogen Peroxide (Mol/l) | Molar Ratio HF: $H_2O_2$ | Solution Temp. (°C.) | Surface Luster | Polishing Rate (μm/min) |
| Present Invention | | | | | | |
| 1 | 0.2 | 0.4 | 1:2.0 | 40 | Yes | 1.2 |
| 2 | 1.0 | 2.0 | 1:2.0 | 40 | Yes | 12.0 |
| 3 | 1.5 | 3.0 | 1:2.0 | 40 | Yes | 46.0 |
| 4 | 2.0 | 4.0 | 1:2.0 | 40 | Yes | 98.0 |
| 5 | 1.0 | 1.5 | 1:1.5 | 40 | Yes | 11.0 |
| 6 | 1.0 | 2.5 | 1:2.5 | 40 | Yes | 13.5 |
| 7 | 1.0 | 2.8 | 1:2.8 | 40 | Yes | 14.5 |
| 8 | 1.0 | 2.0 | 1:2.0 | 50 | Yes | 13.8 |
| 9 | 1.0 | 2.0 | 1:2.0 | 30 | Yes | 8.4 |
| 10 | 1.0 | 2.0 | 1:2.0 | 20 | Yes | 5.9 |
| 11 | 0.4 | 0.8 | 1:2.0 | 40 | Yes | 4.0 |
| 12 | 1.0 | 1.7 | 1:1.7 | 40 | Yes | 11.6 |
| 13 | 1.0 | 2.3 | 1:2.3 | 40 | Yes | 13.2 |
| 14 | 1.2 | 2.8 | 1:2.3 | 40 | Yes | 19.9 |

TABLE 2-continued

| Sample No. | Solution Composition: Hydrofluoric Acid (Mol/l) | Hydrogen Peroxide (Mol/l) | Molar Ratio HF: $H_2O_2$ | Solution Temp. (°C.) | Ability Estimation: Surface Luster | Polishing Rate (μm/min) |
|---|---|---|---|---|---|---|
| 15 | 1.4 | 2.4 | 1:1.7 | 40 | No | 21.4 |
| Comparative Example | | | | | | |
| C1 | 0.1 | 0.28 | 1:2.8 | 40 | No | 0.3 |
| C2 | 0.1 | 4.0 | 1:40 | 40 | Yes | 0.4 |
| C3 | 2.5 | 2.5 | 1:2.0 | 40 | Yes | 248 |
| C4 | 2.5 | 2.5 | 1:1.0 | 40 | No | 159 |
| C5 | 1.0 | 1.2 | 1:1.2 | 40 | No | 10.2 |
| C6 | 1.0 | 1.2 | 1:5.0 | 40 | Yes | 18.5 |

As is obvious from Table 2, the samples Nos. 1 to 15 polished with the solution having a hydrofluoric acid concentration of 0.2 to 2 mol/l and a hydrogen peroxide concentration of 0.4 to 4 mol/l, a molar ratio of the hydrofluoric acid to the hydrogen peroxide being from 1.5 to 1:2.8, according to the present invention, had a luster (glossy surface) and a polishing rate of from 1.2 to 98.5 μm/min. Among the samples Nos. C1 to C6 were treated with the solutions outside the present invention, the sample No. C1 had no luster and a low polishing rate of 1 μm/min or less, similar to that of the sample No. C2; a polishing rate of the sample No. C3 was greatly increased, so that the polishing treatment was not controlled; the sample Nos. C4 and C5 had a non-glossy, satin-like surface; and in the sample No. C6, although the glossy surface was obtained and the polishing rate was similar to that of the present invention, the solution was quickly and severely decomposed, and thus the polishing rate was rapidly lowered.

EXAMPLE 2

Samples Nos. 16 and 17 (rods) having a diameter of 15 mm and a length of 100 mm were made of chromium-molybdenum steel (JIS SCM 420H) and nickel-chromium-molybdenum steel (JIS SNCM 420H), respectively, and the samples were carburized, quench hardened and tempered under the conditions shown in Table 1 of Example 1. A sample No. 18 having the same dimensions as the samples Nos. 16 and 17 was made of carbon steel (JIS S55C) and was hardened by an induction hardening treatment at a frequency of 150 kHz, to form a hardened layer having an effective hardened depth of 1 to 2 mm. Then, these three hardened samples were ground to a surface roughness Rz of about 4 μm.

The commercial hydrofluoric acid, the commercial hydrogen peroxide aqueous solution, and an deionized water were mixed to prepare a chemical polishing solution having a composition having a hydrofluoric acid concentration of 1 mol/l, a hydrogen peroxide concentration of 2 mol/l, and a molar ratio of the hydrofluoric acid to the hydrogen peroxide of 1:2, according to the present invention.

After the samples were degreased with an alkaline cleaner, the samples were immersed for 3 minutes in the chemical polishing solutions kept at 40° C., and were washed, drained, and dried. The surfaces of the samples had mirror-likely brightened good luster. A polished depth of the samples was measured, to thereby calculate the polishing rate. A surface roughness of the samples was measured before and after the polishing treatment The results are shown in Table 3.

TABLE 3

| Sample No. | Roughness (μmRz) Before | After | Polished Depth (μm) | Polishing Rate (μm/min) |
|---|---|---|---|---|
| 16 | 4.2 | 0.62 | 35 | 11.7 |
| 17 | 3.8 | 0.49 | 37 | 12.7 |
| 18 | 3.2 | 0.55 | 35 | 11.7 |

As Obvious from Table 3, the surface roughness was remarkably reduced by a chemical polishing treatment for 3 minutes. Furthermore, regardless of the kind of steel, the polished depth and polishing rate were almost the same, respectively, and thus a highly efficient polishing rate was obtained.

EXAMPLE 3

Two samples were prepared in the same manner as Example 1, namely, the samples of chromium steel (JIS SCr 420H) having the same dimensions and roughness, were heat treated under the same conditions, and were degreased with the same alkaline cleaner as in Example 1.

Two chemical polishing solutions were prepared in the same manner as Example 1. A first (high concentration solution) of the two solutions had the same composition as that of the solution for the sample No. 2, and a second (low concentration solution) had the same composition as that of the solution for the sample No. 1 in Table 2.

One of the samples was immersed in the first chemical polishing solution (40° C.) for 3 minutes, taken out, kept for 20 seconds, immersed in the second chemical polishing solution (40° C.) for 10 seconds, and then kept for 20 seconds. Then, the polished sample was washed, drained and dried in the same manner as Example 1. The sample had a good luster (glossy surface).

For a comparison with the above-mentioned sample, the other sample was immersed in the first (high concentration) solution (40° C.) for 3 minutes, taken out, kept for 20 seconds, and washed, drained and dried, thus omitting the second solution treatment. This sample had a dull luster surface, since the chemical reaction of the solution adhering to the sample surface further proceeded during the holding before the washing.

EXAMPLE 4

A gear sample (module: 2.75, pitch circle radius: 85 mm, tooth number: 28) was made of a chromium steel (JIS SCr 420H) and carburized, quench hardened and tempered under the conditions shown in Table 1 of Example 1.

The polishing solution used in Example 2 was prepared as a chemical polishing solution. After the gear sample was cleaned in the same manner as that of Example 1, the gear was immersed for 2.5 minutes in the chemical polishing solutions kept at 40° C. Then, the gear sample was washed, drained and dried, and the gear sample had a bright finished. To examine changes in the dimensions of the gear, the polished depths of the sample were measured at a tooth-root, a tooth-face and a tooth-tip, to calculate the polishing rates. The results are shown in Table 4.

TABLE 4

| Measurement Position | Polished Depth (μm) | Polishing Rate (μm/min) |
|---|---|---|
| Tooth-Root | 28 | 11.2 |
| Tooth-Face | 29 | 11.6 |

TABLE 4-continued

| Measurement Position | Polished Depth (μm) | Polishing Rate (μm/min) |
|---|---|---|
| Tooth-Tip | 31 | 12.4 |

As is obvious from Table 4, the polished depths and polishing rates at the tooth-root, tooth-face and tooth-tip were almost the same values, and thus a hardened steel article with a complicated shape (e.g., gear) was polished at a high accuracy.

EXAMPLE 5

The chemical polishing solution containing a hydrofluoric acid 1 mol/l in concentration and a hydrogen peroxide 2 mol/l in concentration was prepared by mixing a commercial hydrofluoric acid, a commercial hydrogen peroxide aqueous solution, and a deionized water, as described in Example 2. Hardened steel article samples of a chromium steel (JIS SCr 420H) were polished by immersing same in the solution, with the result that metal ions were accumulated to 40 g/l. Then, the solution was supplemented with the commercial hydrofluoric acid and the commercial hydrogen peroxide aqueous solution, to control the concentrations to the initial values, respectively. During such preparation, a stabilizer of caffeine, theophylline or theobromine was also added in amounts shown in Table 5, to obtain solution samples A to H. For comparison with these solution samples, a well-known stabilizer of uric acid, orthoaminobenzoic acid or polyoxyethyleneoctylphenylether was added in amounts shown in Table 5, to obtain comparative solution samples I to M.

Then, the solution samples were maintained at 40° C. and the concentration of the hydrogen peroxide thereof was analyzed. The concentration gradually dropped with the lapse of time to 1.5 mol/l, for a certain time, and this time was determined as a stabilizing time. The results are shown in Table 5. Note that the analysis of the hydrogen peroxide concentration was performed by the permanganate titration method.

As is obvious from Table 5, the use of a purine alkaloid compound stabilizer stabilized the hydrogen peroxide for a long time, to thus extend a service life of the chemical polishing solution.

TABLE 5

| Solution Sample | | Stabilizer | Added Amount (g/l) | Stabilizing Time (hr) |
|---|---|---|---|---|
| Prasent Invention | A | Caffeine | 0.1 | 3 |
| | B | Caffeine | 0.3 | 6 |
| | C | Caffeine | 1.0 | 15 |
| | D | Caffeine | 3.0 | 32 |
| | E | Caffeine | 10.0 | 70 |
| | F | Caffeine | 30.0 | >100 |
| | G | Theophylline | 3.0 | 15 |
| | H | Theobromine | 3.0 | 13 |
| Comparative Example | I | Orthoaminobenzoic Acid | 0.1 | 1 |
| | J | Orthoaminobenzoic Acid | 0.3 | 2 |
| | K | Orthoaminobenzoic Acid | 3.0 | 6.5 |
| | L | Uric Acid | 3.0 | 3 |
| | M | Polyoxyethylena-octylphenylether | 3.0 | 3.5 |

EXAMPLE 6

Test pieces (fillet-notched specimens) having a test portion 6 mm thick and 10 mm wide, and a notch 1 mm in radius were prepared from a round chromium steel 30 mm in diameter (JIS SCr 420H) and then were carburized, quench hardened and tempered under conditions shown in Table 6. After the heat treatment, the test pieces were degreased with an alkaline cleaner.

TABLE 6

| Treatment | Condition |
|---|---|
| Carburizing | 950° C. × 150 min |
| Quenching | 850° C. × 30 min Holding then Oil Cooling |
| Tempering | 150° C. × 60 min Holding then Air Cooling |

Next, in accordance with processes and conditions shown in Table 7, sample Nos. 21 and 22 of the heat treated test pieces were subjected to a shot-peening step and a chemical polishing step (according to the present invention). In the shot-peening step, shots (steel particles) having an average hardness of HV 800 or HV590 and an average diameter of 0.66 mm collided with the sample Nos. 21 and 22 at a rate of 50 to 70 m/sec for 1 minute. In the chemical polishing step, the sample Nos. 21 and 22 were immersed in the chemical polishing solution used in Example 2 and kept at 40° C., for 1.5 to 2.5 minutes, to give a glossy finish to the surface thereof (i.e., remove a surface layer having a thickness of 20 to 30 μm). Then the surface roughnesses and residual compressive stress at the surface and at a depth of 50 μm of the polished samples were measured. The results are shown in Table 8.

As comparative examples, a sample No. C11 of the heat treated test pieces was not subjected to the shot-peening and chemical polishing, sample Nos. C12 and C13 were subjected to the shot-peening using the shots (HV 800 or HV 590), and a sample No. C14 was subjected to etching using an aqueous solution of $HNO_3$ to remove (chemically dissolve) a surface layer having a thickness of 20 to 30 μm, and to the shot-peening with HV 800 shots. The sample Nos. C12, C13 and C14 were not chemically polished. The surface roughness and residual compressive stress at the surface and at a depth of 50 μm of these comparative samples were then measured, and the results are shown in Table 8.

TABLE 7

| Sample No. | | Process | | |
|---|---|---|---|---|
| Present Invention | 21 | Carburizing → Hardening | Shot-Peening → (Shot HV590) | Chemical Polishing (20–30 μm) |
| | 22 | Carburizing → Hardening | Shot-Peening → (Shot HV800) | Chemical Polishing (20–30 μm) |
| Comparative Example | C11 | Carburizing and Hardening Only | | |
| | C12 | Carburizing → Hardening | Shot-Peening (Shot HV590) | |
| | C13 | Carburizing → Hardening | Shot-Peening (Shot HV800) | |
| | C14 | Carburizing → Hardening | $HNO_3$ → Etching ($30^3$ μm) | Shot-Peening (Shot HV800) |

TABLE 8

| Sample No. | | Residual Surface | Stress (kg/mm²) 50 μm depth | Roughness (μmRz) |
|---|---|---|---|---|
| Present Invention | 21 | −115 | −125 | 2 |
| | 22 | −140 | −165 | 3 |
| Comparative | C11 | 0 | −25 | 2 |

TABLE 8-continued

| Sample No. | | Residual Surface | Stress (kg/mm²) 50 μm depth | Roughness (μmRz) |
|---|---|---|---|---|
| Example | C12 | −40 | −125 | 7 |
| | C13 | −50 | −165 | 10 |
| | C14 | −110 | −155 | 7 |

To examine the fatigue strength thereof, all of the samples of the test pieces were subjected to a pulsating bending fatigue test to obtain a relationship between a stress amplitude and a number of cycles to failure. The results are shown in FIG. 1. In FIG. 1, the abscissa indicates a number of cycles (repetition) of the bending, and the ordinate indicates a repeated stress (stress amplitude) which are values relative to the fatigue limit (corresponding to a horizontal line portion) of the sample No. C11 as 1.0.

As obvious from FIG. 1, compared to the comparative carburized and hardened only steel article (sample No. C11), the fatigue limit of the sample Nos. C12 and C13 is improved by 7 to 30% by the shot-peening, that of the sample No. C14 is improved by about 37% by the etching and shot-peening, and that of the sample Nos. 21 and 22 is remarkably improved by 44 to 63% by the shot-peening and chemical polishing according to the present invention. Thus, the hardened steel article produced in accordance with the treating process of the present invention has a high fatigue strength, since the article has higher residual compressive stresses at the surface and at the 50 μm depth and a smoother surface than the hardened steel articles treated by conventional processes, as shown in Table 8.

EXAMPLE 7

Test pieces (fillet-notched specimens) having a test portion 6 mm thick and 10 mm wide, and a notch 0.5, 1 or 2 mm in radius, were prepared from a round chromium steel 30 mm in diameter (JIS SCr 420H), and then carburized, quench hardened and tempered under the conditions shown in Table 6 of Example 6.

Then, the heat treated test pieces were subjected to a shot-peening step and a chemical polishing step in accordance with the process of the present invention, to obtain samples Nos. 23, 24 and 25. In the shot-peening step, shots (steel particles) having an average hardness of HV 800 and an average diameter of 0.66 mm collided with these samples at a velocity of 50 to 70 m/sec for 1 minute. In the chemical polishing step, these samples were immersed in the chemical polishing solution used in Example 2 and kept at 40° C., for 1.5 to 2.5 minutes, to give a bright polish to the surface thereof (i.e., remove a surface layer having a thickness of 20 to 30 μm). As comparative samples, the heat-treated test pieces having different notches were used as sample Nos. C15, C16 and C17, respectively, as they were.

All of the samples of the test pieces were subjected to a pulsating bending fatigue test in the same manner as Example 6, to obtain a relationship between a stress amplitude and a number of cycles before failure. The results for the fatigue limit (corresponding to a horizontal line portion of S-N curve) are shown in Table 9. In Table 9, the fatigue limits are relative values to those of comparative samples, with the same size notch regarded as 100.

TABLE 9

| Sample No. | Notch Radius (mm) | Fatigue Limit |
|---|---|---|
| 23 | 0.5 | 180 |
| C15 | | 100 |
| 24 | 1.0 | 163 |
| C16 | | 100 |
| 25 | 2.0 | 155 |
| C17 | | 100 |

As is obvious from Table 9, the fatigue limits of the samples with different notch radiuses treated by the shot-peening and chemical polishing are improved by 55% or more, compared with those of the comparative samples. Thus, according to the present invention, it is unnecessary to use a special electrode and device used in a conventional electrolytic polishing process for a complicated shape article with, e.g., notched portions, and it is possible to attain a high fatigue strength by a convenient process (shot-peening and chemical polishing steps without special devices).

EXAMPLE 8

Helical gear samples (module: 2.25, pitch circle diameter: 117 mm, tooth number: 46) were made of three kinds of steels (JIS SCr 420H, JIS SCM 420H and JIS SNCM 420H) and carburized, quench hardened and tempered under the conditions shown in Table 6 of Example 6.

Then, three of the heat treated gears were subjected to a shot-peening step and a chemical polishing step in the same manner as Example 7 to obtain samples Nos. 27, 28 and 29, except that the shot-peening step was performed for 3 minutes. As comparative samples, three other of the heat treated gears were used as sample Nos. C18, C19 and C20, respectively, as they were.

All of the samples of the helical gears were subjected to a pulsating type tooth-root bending fatigue test, to estimate a tooth-root fatigue strength. The results are shown in Table 10. In Table 10, the toothroot fatigue strengths of the sample Nos. 27, 28 and 29 are relative values to those of the comparative sample Nos C18, C19 and C20 of the same steel, regarded as 100.

TABLE 10

| Sample No. | Gear Material | Fatigue Strength |
|---|---|---|
| 27 | SCr 420H | 170 |
| C18 | | 100 |
| 28 | SCM 420H | 170 |
| C19 | | 100 |
| 29 | SNCM 420H | 178 |
| C20 | | 100 |

As is obvious from Table 10, the fatigue strengths of the gears treated by the shot-peening and chemical polishing are improved by 70% or more, compared with those of the comparative samples, regardless of the steel used. Thus, the improvement proportion of Example 8 is remarkably increased compared with Examples 6 and 7, since an initial surface roughness (about 10 μm Rz) of a tooth-root important for fatigue strength of the gear is larger than the surface roughness in Examples 6 and 7, and is remarkably improved by several micrometers (μm) by the shotpeening and chemical polishing, to largely increase the fatigue strength.

It will be obvious that the present invention is not restricted to the above-mentioned embodiments and that may variations are possible for persons skilled in the art without departing from the scope of the invention.

We claim:

1. A brightening chemical polishing solution for brightening a hardened steel article consisting essentially of hydrofluoric acid having a molar concentration of from 0.2 to 2 mol/l, hydrogen peroxide having a molar concentration of from 0.4 to 4 mol/l, and water, a molar ration of said hydrofluoric acid to said hydrogen peroxide being from 1:1.5 to 1:2.8.

2. A brightening chemical polishing solution according to claim 1, wherein the molar concentration of said hydrofluoric acid is from 0.3 to 1.5 mol/l, the molar concentration of said hydrogen peroxide is from 0.6 to 3.0 mol/l, and said molar ratio is from 1:1.6 to 1:2.4.

3. A brightening chemical polishing solution according to claim 1, wherein said water is a deionized water.

4. A brightening chemical polishing solution for brightening a hardened steel article comprising i) hydrofluoric acid having a molar concentration of from 0.2 to 2 mol/l;

ii) hydrogen peroxide having a molar concentration of from 0.4 to 4 mol/l;

iii) a stabilizer of a purine alkaloid compound; and iv) water;

wherein said solution has a molar ratio of hydrofluoric acid to hydrogen peroxide of from 1:1.5 to 1:2.8.

5. The brightening chemical polishing solution of claim 4, wherein said molar concentration of said hydrofluoric acid is from 0.3 to 1.5 mol/l, said molar concentration of said hydrogen peroxide is from 0.6 to 3.0 mol/l, and said molar ratio is from 1:1.6 to 1:2.4.

6. The brightening chemical polishing solution of claim 4, wherein said water is a deionized water.

7. The brightening chemical polishing solution of claim 4, wherein said purine alkaloid compound has a concentration of 0.1–30 g/l.

8. The brightening chemical polishing solution of claim 4, wherein said purine alkaloid compound is selected from the group consisting of caffeine, theophylline, theobromine and a mixture thereof.

* * * * *